US007244897B2

(12) United States Patent
Villagrasa et al.

(10) Patent No.: US 7,244,897 B2
(45) Date of Patent: Jul. 17, 2007

(54) OPENING SWITCH FOR VEHICLE DOORS OR TRUNKS

(75) Inventors: Victor Villagrasa, Barcelona (ES); Ramon Alvarez Vilchez, Barcelona (ES)

(73) Assignee: Valeo Sistemas De Seguridad S.A., Oleasa De Monserrat (ES)

( * ) Notice: Subject to any disclaimer, the term of this patent is extended or adjusted under 35 U.S.C. 154(b) by 65 days.

(21) Appl. No.: 10/535,949

(22) PCT Filed: Nov. 25, 2003

(86) PCT No.: PCT/EP03/50889

§ 371 (c)(1),
(2), (4) Date: May 24, 2005

(87) PCT Pub. No.: WO2004/051683

PCT Pub. Date: Jun. 17, 2004

(65) Prior Publication Data

US 2006/0043794 A1 Mar. 2, 2006

(30) Foreign Application Priority Data

Nov. 29, 2002 (ES) ..... 200202820

(51) Int. Cl.
*H01H 9/06* (2006.01)
*H01H 13/06* (2006.01)

(52) U.S. Cl. ..... 200/61.85; 200/52 R; 200/302.1; 200/302.2; 200/343

(58) Field of Classification Search ..... 200/17 R, 200/61.58 R, 52 R, 61.85, 520, 530, 293, 200/302.1–302.3, 329, 339, 343
See application file for complete search history.

(56) References Cited

U.S. PATENT DOCUMENTS

| | | | | |
|---|---|---|---|---|
| 3,826,882 | A * | 7/1974 | Giolitti et al. | 200/5 A |
| 4,019,003 | A | 4/1977 | Duerksen | |
| 5,347,427 | A * | 9/1994 | Kinoshita | 361/752 |
| 6,462,291 | B1 * | 10/2002 | Sachs | 200/302.2 |
| 6,626,473 | B1 * | 9/2003 | Klein et al. | 292/347 |
| 6,740,834 | B2 * | 5/2004 | Sueyoshi et al. | 200/600 |
| 6,822,174 | B1 * | 11/2004 | Spies | 200/52 R |
| 6,846,999 | B2 * | 1/2005 | Kawakami et al. | 200/341 |
| 6,914,206 | B2 * | 7/2005 | Mukougawa | 200/556 |
| 7,002,086 | B2 * | 2/2006 | Fuji | 200/305 |

FOREIGN PATENT DOCUMENTS

| | | |
|---|---|---|
| DE | 196 29 198 A1 | 1/1997 |
| FR | 2 820 543 | 8/2002 |
| GB | 2 007 024 A | 5/1979 |
| WO | WO 02063647 | 8/2002 |

* cited by examiner

*Primary Examiner*—Michael A. Friedhofer
(74) *Attorney, Agent, or Firm*—Berenato, White & Stavish

(57) ABSTRACT

An opening switch (1) for vehicle doors or rear hatches comprises an actuator device (5) for activating a microswitch (6) which can be moved between two positions: a first open position in which the actuator device is kept away from the microswitch (6), and a second closing position in which the actuator device is in contact with the microswitch (6). The actuator device for activating the microswitch (6) comprises a rocking actuator (5) which incorporates within itself at least one pair of elastic tongues (7) whose reaction brings about return of the rocking actuator (5).

17 Claims, 4 Drawing Sheets

OPENING SWITCH FOR VEHICLE DOORS OR TRUNKS

This invention relates to an opening switch for vehicle doors or rear hatches of the type which the user operates manually to cause the latch of the door to open after the latch has been released through the corresponding lock.

BACKGROUND OF THE INVENTION

Switches which are fitted to the rear hatches and side doors of vehicles which comprise a body enclosed beneath by a flexible membrane, especially an elastomer material, are known. When the user presses the flexible membrane with his fingers it causes the latch of the lock to open.

A switch of this type comprises means for activating a microswitch which include a bar activating a microswitch; this bar can be moved between two positions, a first open position in which it is kept separate from the said microswitch, and a second closed position in which it is in contact with the said microswitch when the user presses on the flexible membrane, and it returns to its initial resting position when the pressure ceases, as a result of elastic members.

For the function of causing the activating bar to return, known switches have conventional metal helical springs.

It has been found in practice that these switches have some disadvantages.

On the one hand the inclusion of conventional springs to return the activating bar gives rise to a further complication in assembly of the switch and affects its cost.

On the other hand, as the support and the membrane are separate parts, there is no perfect seal between the two parts.

DESCRIPTION OF THE INVENTION

The purpose of the switch for opening the doors or rear hatches of a vehicle according to this invention is to overcome the disadvantages manifested by the devices known in the art, offering a number of advantages which will be described below.

The opening switch for vehicle doors or rear hatches to which this invention relates is characterized in that the means for activating the microswitch comprise a rocking actuator which incorporates within itself at least one pair of elastic tongues whose reaction brings about the return of the said rocking actuator.

In this way the said rocking actuator makes it possible to activate the microswitch, and it also performs the function of returning it to its resting position as a result of the said elastic tongues. Thus a single piece is used and replaces the bar activating the microswitch and the elastic return means of the switches known in the art.

As a consequence a switch is provided which comprises a smaller number of parts, simplifying the process of its manufacture and increasing its reliability.

According to a preferred embodiment of the invention, the rocking actuator and the microswitch are housed within a body which is enclosed by a flexible membrane against which a user presses to cause the rocking actuator to rock from the said first position to the said second position.

This body provides the switch with good mechanical strength.

Advantageously the rocking actuator has sufficient thickness to permit it to rotate when it is activated by the user through the flexible membrane.

According to one embodiment the elastic tongues are located and incorporated in an area close to one of the longitudinal sides of the rocking actuator.

According to another embodiment the elastic tongues are located and incorporated in the central zone along an axis parallel to one of the longitudinal sides of the rocking actuator.

Advantageously the rocking actuator comprises a protuberance which is intended to come into contact with the microswitch.

Preferably the rocking actuator is made of polyoxymethylene, or any elastic plastics such as poly butyl terephthalate (PBT), polyamide (PA), polypropylene (PP), etc.

Advantageously the flexible membrane is injection moulded over the body. A perfect seal is obtained between the two parts in this way.

In one embodiment the flexible membrane comprises within its inner surface a plurality of spaces forming a reticulate structure. These spaces endow the said membrane with good bending ability, as well as offering a substantially flat external surface.

According to one embodiment, the switch incorporates a cover connected to the body.

Advantageously the cover comprises retaining members for the two elastic tongues of the rocking actuator. It may also be secured through pins between the two parts.

In this way, when the user presses the flexible membrane causing the said rocking actuator to rock, the tongues abut against the said retaining members causing them to bend.

According to one embodiment, the retaining members are inclined partitions intended to impart an initial tension on the elastic tongues of the rocking actuator.

Advantageously, the switch according to the invention comprises a connecting member which is injection moulded onto the microswitch.

In this way, as the connecting member is injection moulded onto the microswitch it provides an adequately leaktight seal.

Preferably, the assembly comprising the connector member and the microswitch incorporates hooks and a tang for connection with the cover.

Preferably the cover incorporates tangs on its outer surface for connection to matching openings made in the body, or coinciding holes for the fitting of pins.

According to one embodiment of the invention, the cover and the rocking actuator comprise the same part. In this way the number of pieces in the switch is reduced even more.

Additionally, the body incorporates tangs on its outer surface for fitting onto the frame of the vehicle's door or rear hatch.

BRIEF DESCRIPTION OF THE DRAWINGS

To aid the description given above, drawings are appended in which practical embodiments of the switch for opening vehicle doors or rear hatches according to the invention are illustrated diagrammatically and purely by way of non-restrictive example, in which.

DESCRIPTION OF A PREFERRED EMBODIMENT

FIGS. 1 to 6 show a first embodiment of the opening switch 1 for vehicle doors or rear hatches.

Figure 1:
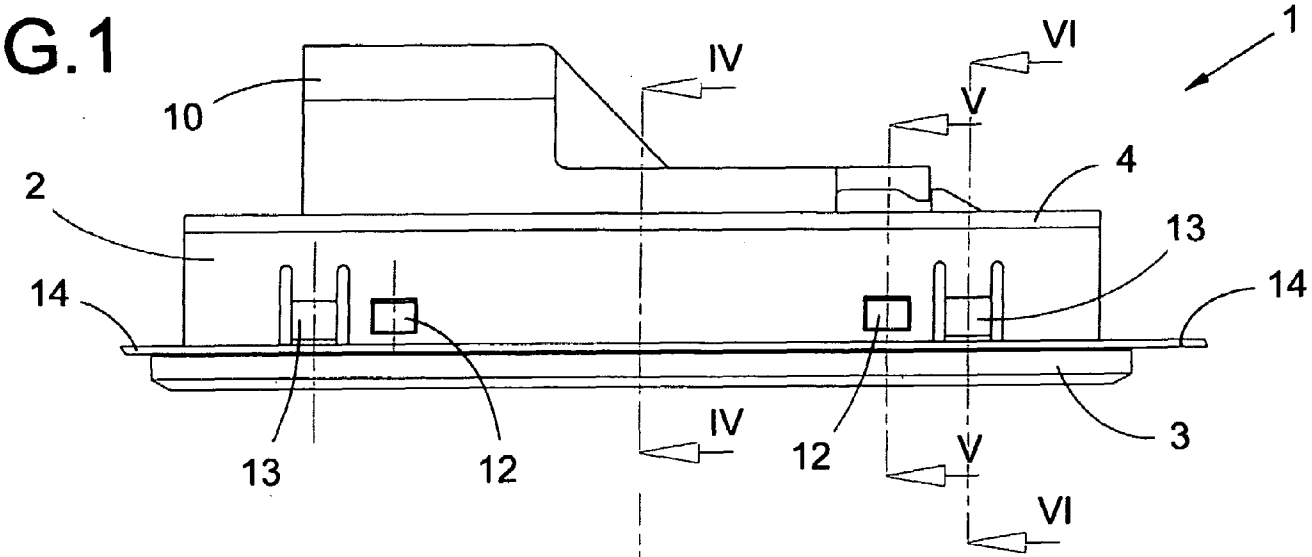
FIG. 1 is a view in elevation of the switch according to the invention in the resting position.
Figure 2:
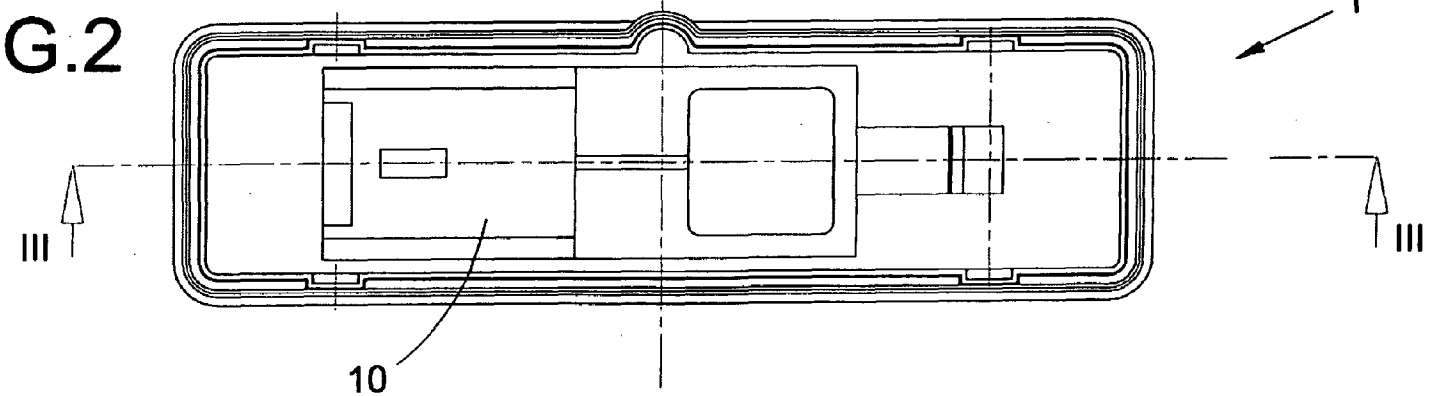
FIG. 2 is a plan view of the switch according to the invention in the resting position.
Figure 3:
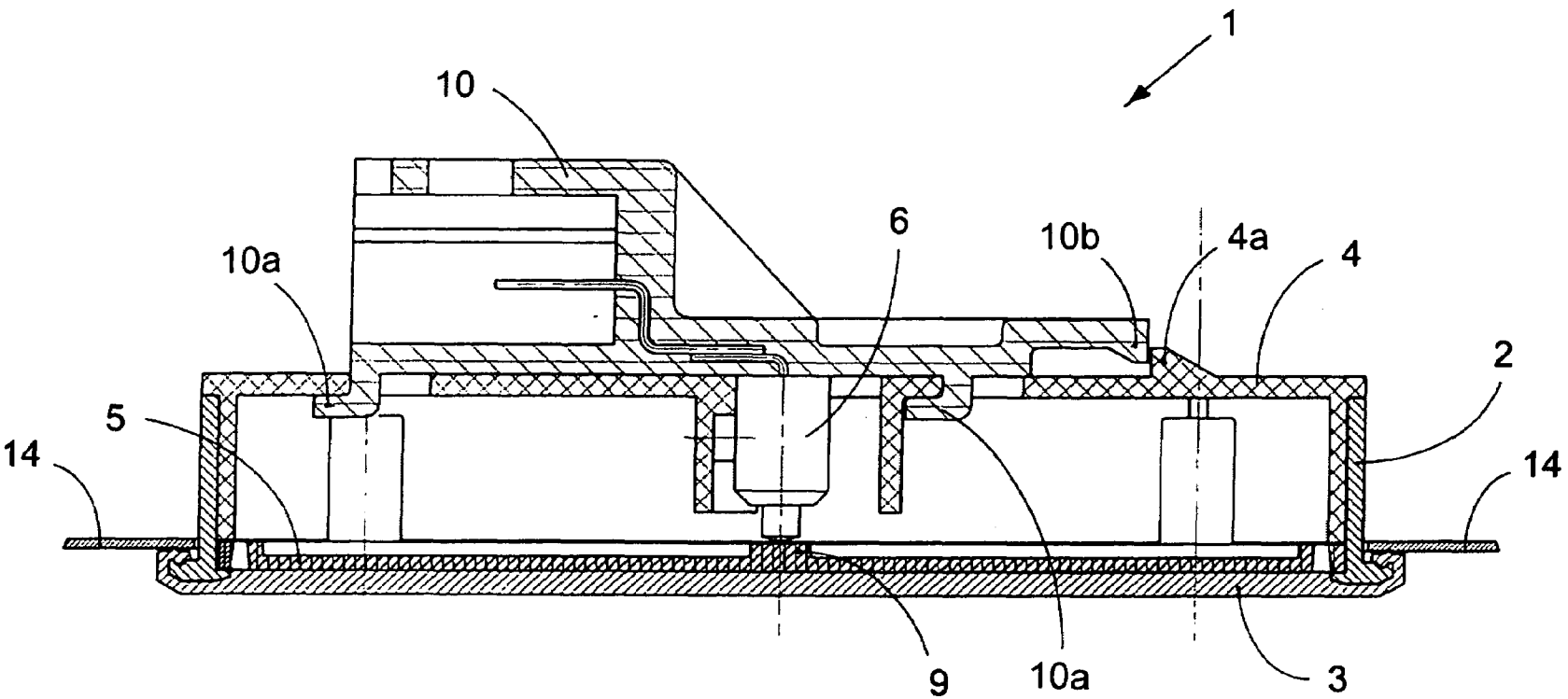
FIG. 3 is a cross-section along the line III—III in FIG. 2.

As may be seen in FIGS. 1 to 3, opening switch 1 comprises a body 2 enclosed beneath by a flexible membrane 3, and enclosed above by a cover 4.

Within body 2 there is a rocking actuator 5 to activate a microswitch 6. Said rocking actuator 5 is manufactured from any kind of plastics material such as PBT, PP, PA or preferably polyoxymethylene.

Rocking actuator 5 is joined by a thin film or narrow piece of material, in the form of a hinge, to an outer frame, the said outer frame being connected between cover 4 and body 2, as shown in FIGS. 3 to 6.

Figure 6:
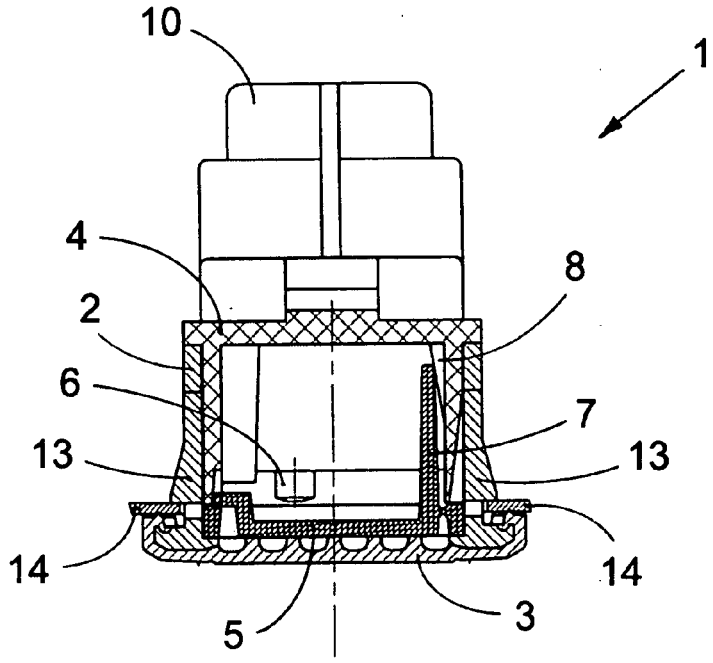
FIG. 6 is a cross-section along the line VI—VI in FIG. 1.

Rocking actuator 5 incorporates within itself a pair of elastic tongues 7 which act as elastic media for return of the said rocking actuator 5, as may be seen in FIG. 6.

As a result of the flexibility of elastic tongues 7 rocking actuator 5 can rock between two positions, a first open position in which it is kept away from microswitch 6 and a second closed position in which it is in contact with said microswitch 6.

In FIG. 3 it can be seen that rocking actuator 5 also comprises a protuberance 9 to facilitate contact with microswitch 6.

Figure 4:
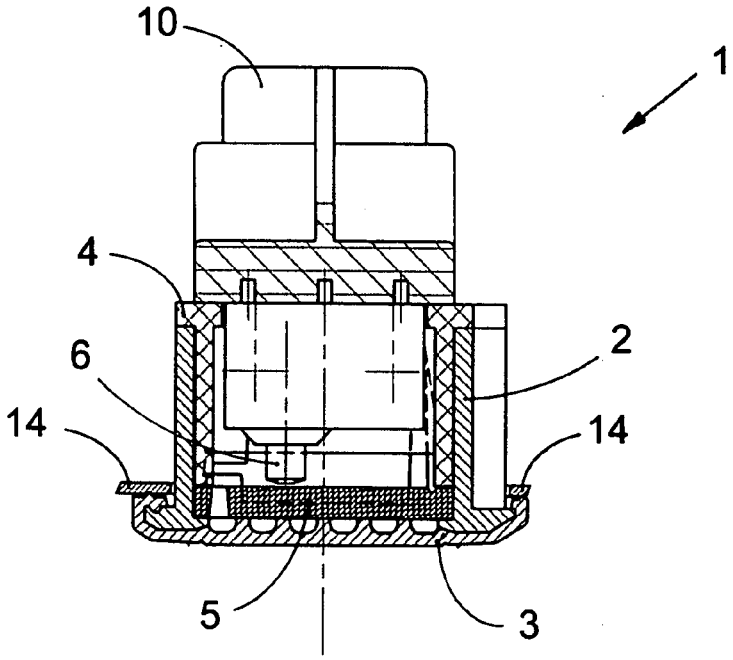
FIG. 4 is a cross-section along the line IV—IV In FIG. 1.
Figure 5:
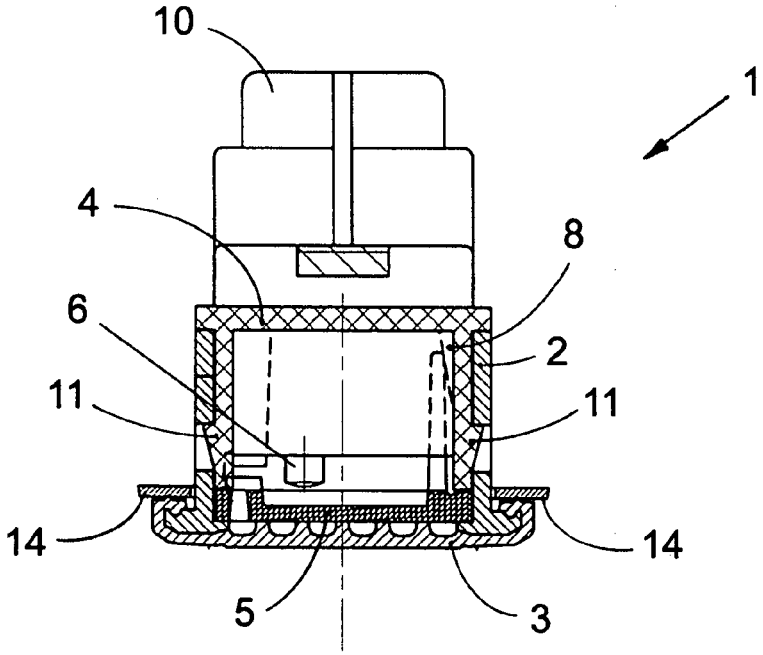
FIG. 5 is a cross-section along the line V—V in FIG. 1.

As may be seen in FIGS. 4 to 6, rocking actuator 5, which includes said elastic tongues 7 In the form of springs and said protuberance 9, is connected between cover 4 and body 2 through a thin film or narrow piece of material in the form of a hinge.

Furthermore, said elastic tongues 7 are supported on retention partitions 8 belonging to cover 4 itself. Said retention partitions 8 impart an Initial tension upon elastic tongues 7.

In this way, when the user presses on flexible membrane 3 to activate switch 1, rocking actuator 5 rocks upwards making it possible to activate microswitch 6. When the user's pressure on membrane 3 ceases, rocking actuator 5 returns to its initial position as a result of tongues 7.

Furthermore, flexible membrane 3 is injection moulded over body 2 ensuring a perfect seal. In addition to this, said flexible membrane 3 comprises a plurality of spaces forming a reticulate structure on its inner surface, as may be seen in the cross-sections in FIGS. 4 to 6, which provides it with good bending ability, prevents shrinkage cavities and achieves a reduction in weight.

As shown in FIG. 3, connector 10 of the circuit is injection moulded over microswitch 6 leaving the electrical connection tabs located within said connector 10, thus ensuring that it is satisfactorily leaktight.

The assembly formed by connector 10 and microswitch 6 comprises hooks 10*a* and a tang 10*b* for connection with cover 4. The said assembly is fitted onto cover 4 by inserting hooks 10*a* in the corresponding housings in cover 4 and then sliding the said assembly until hooks 10*a* and tang 10*b* are anchored against a tooth 4*a* in cover 4.

In order to dismantle the said connector/microswitch assembly it is sufficient to raise tang 10*b* and slide the assembly in a direction opposite to that in which hooks 4*a* engage.

Said cover 4 is connected to body 2 by tangs 11 which project outwards and can be anchored in corresponding openings 12 made in said body 2, as may be seen in FIGS. 1 and 5.

In addition to this, body 2 comprises tangs 13 on its outer surface for connection with the surface of panel 14 of the vehicle door or rear hatch, as shown In FIGS. 1 and 6.

Figure 7:
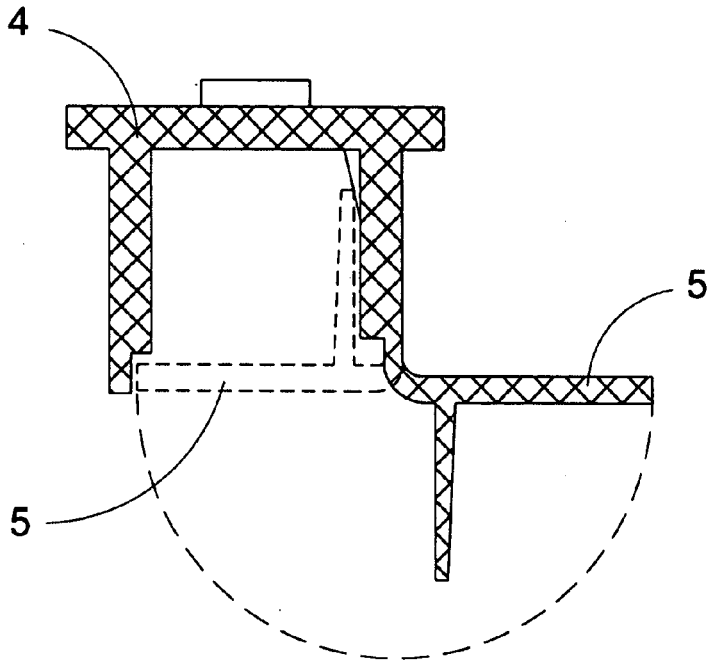
FIG. 7 is a view in elevation of the cover and rocking actuator comprising a single piece in accordance with another embodiment of the invention.

FIG. 7 shows a second embodiment of opening switch 1. In this case rocking actuator 5 and cover 4 comprise a single piece. Rocking actuator 5 is joined to cover 4 through a pivot line which allows it to rotate into its position within said cover 4.

The invention claimed is:

1. An opening switch (1) for vehicle doors or rear hatches, comprising an actuator device (5) for activating a microswitch (6) which can be moved between two positions: a first open position in which the actuator device being kept away from the microswitch (6) and a second closing position in which the actuator device being in contact with the microswitch (6); the actuator device activating the microswitch (6) comprises a rocking actuator (5) including at least one pair of elastic tongues (7) whose reaction brings about return of the rocking actuator (5).

2. The switch (1) according to claim 1, wherein the rocking actuator (5) and the microswitch (6) are housed within a body (2) which is enclosed by a flexible membrane (3) on which a user presses in order to cause the rocking actuator (5) to rock from the said first position to the said second position.

3. The switch (1) according to claim 2, wherein the rocking actuator (5) has sufficient thickness to permit the rocking actuator (5) to rotate when the rocking actuator (5) is activated by the user through the flexible membrane (3).

4. The switch (1) according to claim 3, wherein the elastic tongues (7) are located in and incorporated with a zone close to one of two longitudinal sides of the rocking actuator (5).

5. The switch (1) according to claim 3, wherein the elastic tongues (7) are situated in and incorporated with a central zone along an axis parallel to one of longitudinal sides of the rocking actuator (5).

6. The switch (1) according to claim 2, wherein the flexible membrane (3) is injection moulded over the body (2).

7. The switch (1) according to claim 6, wherein the flexible membrane (3) comprises a plurality of spaces on an inner surface thereof forming a reticulate structure.

8. The switch (1) according to claim 2, further comprising a cover (4) connected to the body (2).

9. The switch (1) according to claim 8, wherein the cover (4) comprises retaining elements (8) for the two elastic tongues (7) of the rocking actuator (5).

10. The switch (1) according to claim 9, wherein the retention members are inclined partitions (8) intended to impart an initial tension upon the elastic tongues (7) of the rocking actuator (5).

11. The switch (1) according to claim 8, further comprising a connecting member (10) which is injection moulded over the microswitch (6).

12. The switch (1) according to claim 11, wherein the connecting member (10) comprises hooks (10*a*) and a tang (10*b*) for connection with the cover (4).

13. The switch (1) according to claim 8, wherein the cover (4) comprises tangs (11) on an outer surface thereof for connection with matching openings (12) in the body (2).

14. The switch (1) according to claim 1, wherein the rocking actuator (5) comprises a protuberance (9) designed to come into contact with the microswitch (6).

15. The switch (1) according to claim 1, wherein the rocking actuator (5) is made of polyoxymethylene.

16. An opening switch (1) for vehicle doors or rear hatches, comprising an actuator device (5) for activating a microswitch (6) which can be moved between two positions: a first open position in which the actuator device being kept away from the microswitch (6) and a second closing position in which the actuator device being in contact with the microswitch (6); the actuator device activating the microswitch (6) comprises a rocking actuator (5) including at least one pair of elastic tongues (7) whose reaction brings about return of the rocking actuator (5); and a cover (4) connected to the body (2);

wherein the rocking actuator (5) and the microswitch (6) are housed within a body (2) which is enclosed by a flexible membrane (3) on which a user presses in order to cause the rocking actuator (5) to rock from the first position to the second position; and wherein the cover (4) and the rocking actuator (5) comprise a single piece.

17. An opening switch (1) for vehicle doors or rear hatches comprising an actuator device (5) for activating a microswitch (6) which can be moved between two positions: a first open position in which the actuator device being kept away from the microswitch (6) and a second closing position in which the actuator device being in contact with the microswitch (6); the actuator device activating the microswitch (6) comprises a rocking actuator (5) including at least one pair of elastic tongues (7) whose reaction brings about return of the rocking actuator (5);

wherein the rocking actuator (5) and the microswitch (6) are housed within a body (2) which is enclosed by a flexible membrane (3) on which a user presses in order to cause the rocking actuator (5) to rock from the first position to the second position; and wherein the body (2) incorporates tangs (13) on an outer surface thereof for mounting on the frame (14) of the vehicle door or rear hatch.

* * * * *